United States Patent [19]

Morrison

[11] 4,397,580

[45] Aug. 9, 1983

[54] VIBRATING SCREED AND CURB/GUTTER FORMING APPARATUS AND METHOD

[76] Inventor: Donald R. Morrison, 6228 Eagle Peak Dr., Charlotte, N.C. 28214

[21] Appl. No.: 323,728

[22] Filed: Nov. 23, 1981

[51] Int. Cl.[3] ..... E01C 19/22; E01C 3/06

[52] U.S. Cl. ..... 404/72; 404/98; 404/114; 404/119; 404/116; 425/63

[58] Field of Search ..... 404/98, 72, 114, 102, 404/119, 108, 115, 110, 113, 116; 425/63

[56] References Cited

U.S. PATENT DOCUMENTS

| | | | |
|---|---|---|---|
| 3,202,068 | 8/1965 | Larsen | 404/98 |
| 3,224,348 | 12/1965 | Maginniss | 404/114 |
| 3,354,801 | 11/1967 | Hanson | 404/108 X |
| 3,377,933 | 4/1968 | Dale | 404/98 |
| 3,412,658 | 11/1968 | Griffin | 404/119 |
| 3,418,902 | 12/1968 | Wilson | 404/119 X |
| 3,472,134 | 10/1969 | Wilbur | 404/113 X |
| 3,555,983 | 1/1971 | Swisher | 404/114 |
| 4,027,990 | 6/1977 | Merrill | 404/98 |
| 4,030,873 | 6/1977 | Morrison | 404/114 X |
| 4,213,749 | 7/1980 | Morrison | 404/119 X |
| 4,249,327 | 2/1981 | Allen | 404/114 |
| 4,253,778 | 3/1981 | Morrison | 404/114 |
| 4,335,976 | 6/1982 | Morrison | 404/114 |
| 4,349,295 | 9/1982 | Morrison | 404/114 |

*Primary Examiner*—Nile C. Byers, Jr.
*Attorney, Agent, or Firm*—B. B. Olive

[57] ABSTRACT

A lightweight, portable, vibrating-type concrete screed utilizes an elongated, open frame structure, is adapted to being winched automatically to screed a concrete-formed road and simultaneously form and smooth associated curbing and guttering with improved vibrator and smoothing means.

6 Claims, 4 Drawing Figures

VIBRATING SCREED AND CURB/GUTTER FORMING APPARATUS AND METHOD

DESCRIPTION

CROSS REFERENCE TO RELATED APPLICATIONS

This application is related to the subject matter of applicant's copending application Ser. No. 251,970, filed Apr. 6, 1981, entitled VIBRATING SCREED AND CURB-FORMING APPARATUS and applicant's prior U.S. Pat. Nos. 4,030,873 and 4,253,778.

TECHNICAL FIELD

The invention relates to vibrating screed and associated apparatus for screeding concrete-formed roads, walkways, and the like, and forming associated curbing and guttering on both sides of the structure being screeded and to the methods thereof.

BACKGROUND ART

Lightweight, portable, vibrating, concrete screeds of the type to which the present invention is related are described in applicant's prior U.S. Pat. Nos. 4,030,873; 4,213,749; and 4,253,778. The general state of the art with respect to such type vibrating concrete screeds is believed to be fully set forth in these references and therefore will not be restated.

As another aspect of the prior art as taught in U.S. Pat. Nos. 3,224,348 and 3,377,933, it has been previously known to provide a screeding apparatus which is also adapted to form curbs on the sides of the slab being screeded. However, it will be noted that the prior art apparatus represents an extremely heavy and relatively complex and therefore relatively expensive type of apparatus. Pouring of concrete roadways is most often seasonal and breakdowns to such complicated machinery are costly in time and labor to contractors attempting to meet job time schedules. Small contractors are most often unable to afford such large machinery for finishing concrete roadways even on a rental basis.

U.S. Pat. No. 3,412,658 is also of interest to the present invention as teaching a relatively simplified road surfacing and single curb-forming device. Also, the screed of this patent utilizes a vibrating shaft to impart vibrations to the screed and also utilizes a motor-driven winching apparatus. However, the screed of this patent is not illustrated as being adapted to form a pair of curbs simultaneously nor does the patent teach the concept of combining the curb forming and winch apparatus in a detachable structure as with the present invention.

U.S. Pat. Nos. 3,472,134; 3,600,773; 3,799,714; and 4,027,990 are further illustrative of small curb gutter and/or sidewalk forming devices. U.S. Pat. No. 4,027,990 is also noted as having a trailing skirt or apron for smoothing the formed curb. So far as can be determined, the described skirt is made of formed sheet metal and therefore would be expected to impart undesirable vibrations to the top surface of the formed curb.

As a general observation, it is believed that the introduction of the screed shown in applicant's copending application Ser. No. 251,970 represents the first commercially available lightweight, portable, vibrating-type concrete screed having the ability to screed an entire roadway simultaneously with forming curbing and guttering on both sides of the roadway and the ability to form crown and valley type formations in the roadway contour. As another observation, it can be said that in those screeds having the ability to form a curb, the customary practice has been to install a vibrator in the hopper throat to vibrate concrete being fed through the hopper to form the curb. The prior art patents will also be noted as teaching the practice of vibrating the hopper structure itself. Further, in those instances where the screed has been provided with a smoothing skirt to smooth the formed curb, no provision has been made to both vibrate the concrete in front of the hopper and also dampen the vibrations imparted to the smoothing skirt so as to both improve curb-forming and smoothing to minimize the amount of follow-up smoothing and touch-up work which is typically required in any screeding and curb-forming operation.

With the foregoing discussion of the prior art in mind, the present invention seeks to provide a still further improved lightweight, portable, vibrating-type concrete screed having the ability to screed an entire roadway simultaneously with forming curbing and guttering on both sides of the roadway. More specifically, the present invention provides an improved apparatus and method for vibrating the concrete immediately in front of the hopper in the direction of screeding, a means for smoothing and dampening vibrations imparted to the formed curb and an improved winching apparatus which can be used independently of the curb-forming apparatus or in conjunction with the curb-forming apparatus. Finally, the present invention seeks to improve upon the screed apparatus disclosed in applicant's copending application Ser. No. 251,970 by utilizing the base unit vibrating shaft as a source of power for operating the winch as well as a probe-type vibrator for vibrating the concrete immediately in front of the hopper. Other objects will become apparent as the description proceeds.

DISCLOSURE OF THE INVENTION

In accordance with the present invention, a portable, lightweight, vibrating concrete screed is provided with detachable winching units and detachable curb/gutter-forming units which may be attached to the ends of a base frame unit, only a fragmentary portion being shown, or to the ends of interconnected frame units, not shown, as taught in applicant's prior application and patents previously referred to.

The base frame unit mounts a drive engine which in turn drives a flexible shaft with mounting arrangements adapted to vibrate the base frame unit throughout its length utilizing any of the various vibrating arrangements disclosed in applicant's prior U.S. Pat. Nos. 4,030,873; 4,213,749; and 4,253,778 by way of example.

An important feature of the present invention is that a probe-type vibrator is adjustably secured to the front of each curb/gutter-forming unit so as to vibrate the concrete immediately in front of each hopper. The vibrators extend into the wet concrete in order to vibrate and work the wet concrete ahead of the screed in the area of the curb/gutter as contrasted to the prior art practice of vibrating the concrete in the hopper throat. The probe-type vibrators are powered off the base unit shaft. This new vibration arrangement and method of vibration imparts a vibration pattern in the wet concrete before it moves under the curb-forming apparatus where the hopper provides any required supplemental concrete. A vibration dampening skirt is secured to the rear and trails each of the curb/gutter units. The newly formed curb and gutter is smoothed with the skirt being as vibration-free as is possible. This procedure and structural arrangement has been found to substantially improve the curb-forming operation and also to substantially improve the smoothing of the freshly molded curb and gutter to maintain their shape as the screed moves on. Also, a substantial reduction in the amount of touch-up and smoothing work has been experienced.

BEST MODE FOR CARRYING OUT THE INVENTION

The general, elongated open frame construction of the present invention generally follows the construction previously disclosed in applicant's prior U.S. Pat. Nos. 4,030,873; 4,213,749; and 4,253,778 which will hereinafter by referred to simply as "the prior patents". The teachings of the prior patents will be deemed incorporated herein by reference and those details which are fully set forth in the prior patents and which are applicable to the present invention may be understood by making reference to the prior patents and will not be repeated here to simplify the description.

Figure 1:
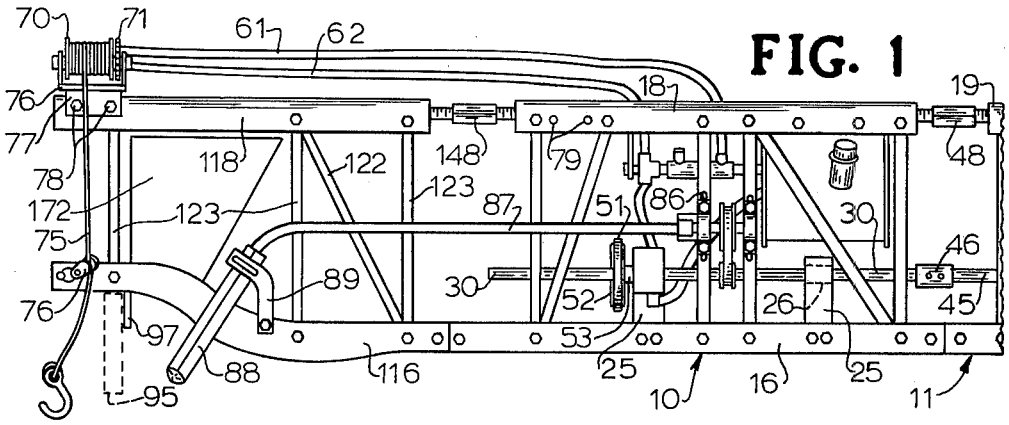
FIG. 1 is a front or leading side elevation view of an interconnected curb/gutter-forming unit and winching unit according to the invention.
Figure 2:
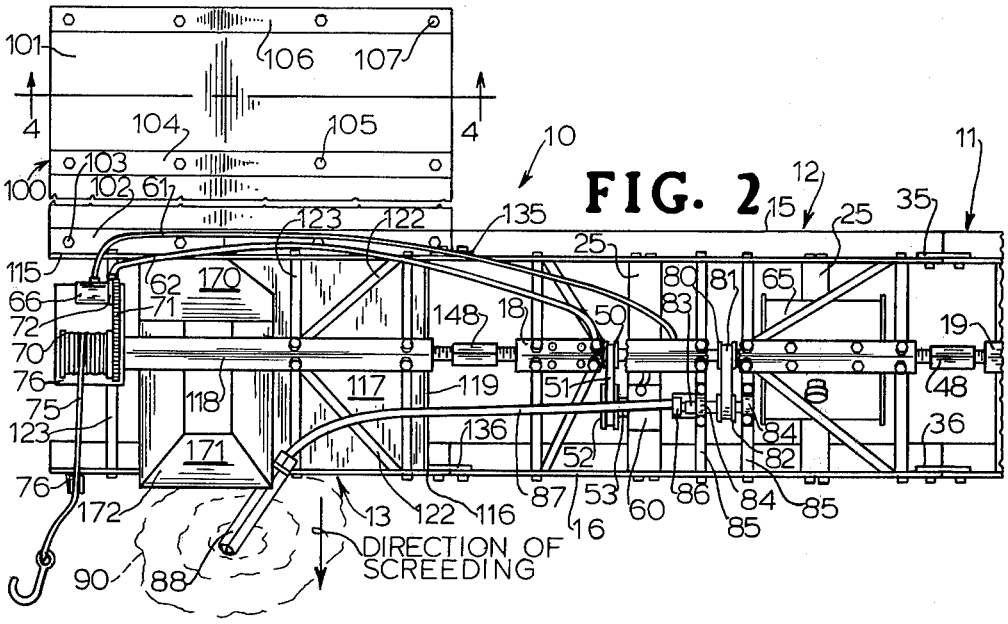
FIG. 2 is a top plan view of the units of FIG. 1.
Figure 4:
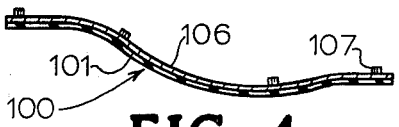
FIG. 4 is a sectional view of the skirt taken along line 4—4 of FIG. 2.

As illustrated in FIGS. 1 and 2, a screed 10 is formed of a base frame unit 11, only a fragmentary portion being shown, constructed as previously described in the prior patents, a pair of detachable winching frame units 12, only one being shown, and a pair of detachable curb/gutter-forming frame units 13, only one being shown. Base frame unit 11, winching units 12, and curb-/gutter-forming units 13 can be of various lengths and can be easily and quickly connected together as later described so as to provide different lengths of screeds for spanning forms of different widths corresponding to roads with curbs and gutters and of varying overall width. It should be clear that there exist a pair of winching units 12 and a pair of curb/gutter units 13 which are typically two and one-half feet in overall length. The individual frame units may be formed of any suitable material but are preferably formed of aluminum to reduce the weight and in a bolted-together construction to facilitate replacement of damaged parts. Since the construction of the base frame unit 11 is fully described in the prior patents, the description will be directed to describing the construction of the winching units 12 and the curb/gutter units 13. Since the left and right hand units of winching units 12 and curb/gutter units 13 are identical in construction, only the left hand units of each will be described as representing the construction used in both right and left hand units.

As in U.S. Pat. No. 4,253,778, each winching frame unit 12 comprises an elongate, open structure frame such as illustrated in FIGS. 1 and 2 including a pair of spaced-apart screed plates 15, 16 which are illustrated as right angular members having vertical and horizontal legs, each of which in the described example are one and three-quarters inches in width. Screed plates 15, 16 extend throughout the length of the winching frame unit and are adapted to engage and finish the concrete as the screed 10 is moved over the concrete in the direction of the arrows shown in FIGS. 2 and 3. Thus, screed plates 15, 16 on left and right winching frame units 12 act as continuations of mating screed plates on base unit 11. While the open structure frame of winching frame units 12 of the invention may take various configurations in cross section, the cross section of winching units 12 should, of course, be compatible with the cross section of base frame unit 11. As illustrated, base frame unit 11 and winching units 12 are preferably in the form of an isosceles triangle. Screed plates 15, 16 of each winching unit 12 form lower corners of the triangle and ridge plate 18 forms the apex of the triangle. Ridge plate 18 extends throughout the length of winching frame unit 12 and is connected to screed plates 15, 16 by suitable cross and vertical braces. A pair of bridging transverse bearing supports 25 are fixed at opposite ends to screed plates 15, 16 and mount bearings 26 which receive in a loose-fitting arrangement, the vibrating shaft 30 which connects to shaft 45 driven by the engine, not shown, on base frame unit 11. As described in U.S. Pat. No. 4,253,778, the semi-flexible shaft 45 also has a loose-fit bearing arrangement in the base frame unit 11 so as to impart substantially uniform vibrations throughout the entire length of the base unit 11. The ends of the base frame unit 11 and the respective winching frame units 12 are provided with means for quickly and easily connecting the left and right winching frame units 12 on the ends of the base frame unit 11 or if base frame unit 11 has been previously extended in length to the ends of the extended base frame unit. This arrangement enables the respective screed plates, e.g., screed plates 15, 16 of the winching frame units to act as extensions of the screed plates of the base frame unit 11.

The coupling arrangement is similar to that previously described in the prior art patents. The ends of the screed plates 15, 16 which are to be joined to the screed plates on the base frame unit 11 are provided with angle extensions 35, 36 fixed at their inner ends to the respective screed plates 15, 16. The outer ends of extension 35, 36 are provided with enlarged bolt holes for receiving connected bolts, or the like, so that the screed plates of the respective winching frame units may be readily connected to the screed plates of the base frame unit 11. Also, the section of vibrating shaft 30 contained in the respective winching frame unit 12 is connected to the drive shaft 45 of the base frame unit 11 which is driven by the engine, not shown, through a coupling 46. Another adjustable connecting sleeve or turnbuckle 48 joins the ridge plate 18 of the respective winching frame unit 12 to the ridge plate 19 of the base frame unit 11. Since the connection arrangement illustrated in FIGS. 1 and 2 can be generally similar to the connection arrangement illustrated in the prior art patents, it is believed that the explanation given will suffice for those skilled in the art.

As best seen in FIGS. 1 and 2, it will be seen that the short length of drive shaft 30 contained in winching frame unit 12 mounts a pulley 50 which through a belt 51 drives another pulley 52. Pulley 52 is mounted on a shaft 53 which is connected to drive an oil pump 60 to circulate fluid under pressure between a reservoir 65 and a fluid motor 66 mounted on curb/gutter unit 13. Motor 66 drives a winching drum 70 through a belt 71 and drive pulley 72. Thus, the winching cable 75 which is tracked through appropriate guide 76 and is secured to appropriate anchors, not shown, can be used to pull screed 10. Appropriate flow valve means of the type discussed in prior U.S. Pat. No. 4,253,778 allow the speed of fluid motor 66 to be adjusted and, while not shown, the piping system includes a fluid pressure gauge and pre-set pressure overload valves as needed.

In the prior patents, pump 60 and motor 66 were shown situated on winch unit 12; however, in the present invention the appropriate hydraulic fluid piping extends from pump 60 to fluid motor 66 which is advantageously mounted on the curb/gutter unit 13 for more direct pulling. Since the general operation of fluid motors in this type of arrangement is well understood in the art, it appears sufficient to note simply that when the segmental shaft 30 is driven by main vibrating shaft 45 of base frame unit 11, pump 60 will circulate fluid, e.g., oil, between reservoir 65 and fluid motor 66 through the appropriate piping so as to operate cable drum 70 and reel cable 75. During operation, it will also be understood that each of the winching units will have its own respective control, not shown, to control the speed of operation of the respective cable drum. Thus, the overall screed 10 can be either operated perpendicular to guide forms 95 or the winches can be set to operate screed 10 at a selected angle on the guide forms 95 according to job requirements.

Another feature of the present invention utilizes a second power take-off from drive shaft 30 on winching units 12. A second pulley 80 mounts on shaft 30 and through belt 81 drives another pulley 82. Pulley 82 is rotatably mounted on shaft 83 which extends between and rotates within adjustable bearing mounts and bearings 84. Bearings 84 are adjustably mounted on vertical brace members 85 which extend between ridge plate 18 and screed plate 16 of winch unit 12. Bearings 84 are adjustable by screws 86 so that belt 81 may be loosened or tightened as desired. Coupling 86 connects with one end of shaft 83 and drives a flexible shaft 87 of a probe-type vibrator 88 which is mounted on curb/gutter unit 13. The probe-type vibrator is well known for use in vibrating concrete form work, e.g., concrete columns, and basically comprises an elongated shaft-driven vibrator enclosed in a tubular housing.

Figure 3:
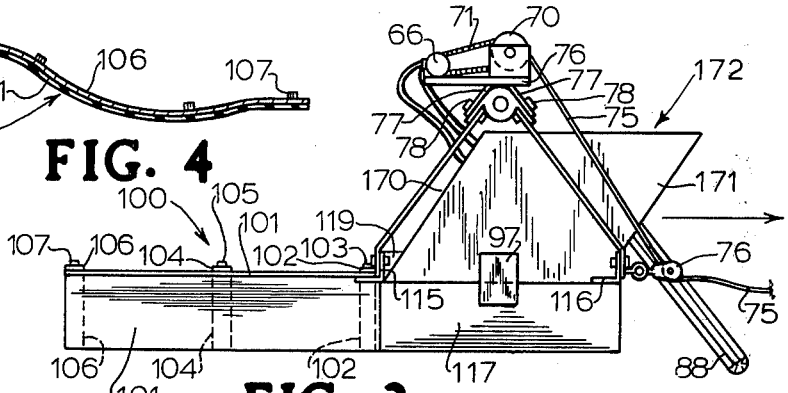
FIG. 3 is a left end elevation view of the curb/gutter-forming unit.

Each curb/gutter-forming frame unit 13 comprises an elongate, open structure frame such as illustrated in FIGS. 1–3. Each such structure frame includes a pair of spaced-apart screed plates 115, 116 on the connection end of each curb/gutter unit 13 and which are illustrated as being L-shaped. Screed plates 115, 116 act as continuations of mating screed plates 15, 16 on base unit 11. The bottom screed surfaces provided by screed plates 115, 116 smoothly merge into a double curved screed plate 117 mounted on the bottom and at the curb/gutter-forming end of unit 13 for forming the particular desired shaped curb with a "drive over" type curb being used by way of illustration. The screed plates 115, 116 together with curb/gutter-forming plate 117 extend for the length of the curb/gutter-forming frame unit and are adapted to engage and finish the concrete and form a curb and gutter as the screed is moved over the concrete. An upturned vertical edge portion 119 of plate 117 prevents excess concrete from getting onto the top surface of plate 117.

While the open structure frame of the curb/gutter-forming frame unit 13 may take various configurations in cross section, the cross section of unit 13 should be compatible with the cross section of the winching unit 12 and the base frame unit 11. Unit 13 is illustrated in the form of an isosceles triangle with screed plates 115, 116 forming the lower corners of the triangle and with ridge plate 118 forming the apex of the triangle.

The ridge plate 118 extends throughout the length of unit 13 and is connected to screed plates 115, 116 by suitable cross and vertical braces 122, 123. Each winching unit 12 and curb/gutter-forming unit 13 are provided with means enabling respective left and right curb/gutter-forming frame units 13 to be easily connected to the respective ends of winching frame units 12. This arrangement enables the respective screed plates 115, 116 of the curb-gutter forming frame units 13 to act as extensions of the screed plates of the winching frame units 12.

The coupling arrangement is similar to that previously described in the prior art patents in that the ends of the screed plates 115, 116 which are to be joined on the screed plate on winching units 12 are provided with angular extensions 135, 136 fixed at their inner ends to the respective screeds 115, 116 with the outer ends thereof being provided with enlarged bolt holes for receiving connecting bolts, or the like. Screed plates 115, 116 of the respective curb/gutter-forming frame units 13 may thus be readily connected to screed plates 15, 16 of winching units 12. Another adjustable connecting sleeve 148 joins ridge plate 118 of the respective curb/gutter-forming frame unit 13 to the ridge member 18 of the winching unit 12.

A concrete mix hopper 172 has an open top and an open bottom extending through an opening provided in the previously-mentioned double curved curb/gutter-forming plate 117. The back and front walls 170, 171 of hopper 172 are angled forwardly to assist the flow of the concrete mix towards the curb area to compress it into the curb form. Any concrete mix placed in hopper 172 works its way downwardly through the open bottom of hopper 172 and through the opening provided in the curb/gutter-forming plate 117. By keeping hoppers 172 in both curb/gutter forming units 13 full of concrete mix, such mix will be continuously passed downwardly through hoppers 172 and through the curb/gutter-forming plate 117 so as to form the respective curb/gutter-formations on both sides of the road being constructed.

Previously-mentioned probe-type vibrator 88 is adjustably mounted on screed plate 116 by means of bracket 89 which is adjustably mounted on plate 116. Probe vibrator 88 is adjustable on bracket 89 so that the proper depth for vibrator 88 may be obtained by adjustment. As previously mentioned, probe-type vibrator 88 is powered through flexible shaft 87 which is driven through appropriate couplings and shafts by vibrating shaft 30 of winching unit 12. By so mounting vibrator 88 on the front of curb/gutter-forming frame unit 13, the wet concrete already poured in front of the curb/gutter-forming frame unit 13 may be worked, i.e., vibrated, prior to being mixed with the curb concrete mix material being poured through hopper 172 immediately behind the location of vibrator 88. A highly desired field of vibration, generally indicated by dashed lines 90, is set up in the wet concrete by probe type vibrator 88. Essentially all the vibration effect produced by vibrator 88 is transmitted to the concrete. Aside from the vibration which is transmitted to hopper 172 through the frame structure from the vibrating shaft 30, it has been observed that hopper 172 operates satisfactorily without requiring a vibrator directly attached to hopper 172 or a vibrator rod in contact with the concrete mix within hopper 172 as found in prior art apparatus.

Another significant feature of the present invention resisides in the incorporation of a mold skirt 100. Mold skirt 100 is comprised of a large, relatively thick, rubber sheet 101 which at one end is fixedly secured to screed plate 115 along its trailing edge (see FIGS. 2 and 3). Sheet 101 conforms to the double curve of plate 117 and a metal strip 102 secures sheet 101 between plate 117 and strip 102 by bolts 103. Approximately midway sheet 101, a second metal strip 104 which is also preshaped in the double curve form of plate 117 is placed on the top of sheet 101 and is secured by bolts 105. At the most rearward, trailing end of sheet 101, a third metal strip 106 having the same double curvature as plate 117, is placed on top of sheet 101 and secured by bolts 107. Mold skirt 100 provides a smoothing surface as a continuation of a moldng surface of plate 117 and also serves to dampen any vibrations that might otherwise be imparted to the freshly molded curb. In this manner, the freshly formed curb is smoothed without vibrating its molded shape. Sheet 101 preferably extends behind the curb/gutter-forming frame unit 13 a sufficient length to accomplish both functions and its dimensions will, of course, vary with the size of frame unit 13. While a relatively thick, e.g., ½ inch, rubber sheet has been found to be suitable for the purpose of sheet 101, it will be appreciated that sheet 101 could be formed of any suitable material adapted to be shaped as described and further adapted to absorb vibrations.

With further reference to the winching apparatus of screed 10, piping 61, 62 connects fluid motor 66 with pump 60. Motor 66 drives pulley 72 which in turn drives belt 71 which drives winching drum 70 through an approximate pulley. Cable 75 is tracked through guide 76 and is secured to appropriate anchors, not shown, so that screed 10 can be pulled forward. Motor 66 and pulley 70 are supported on curb/gutter unit 13 by plate 76 which in turn is supported on ridge plate 118 by brackets 77 and bolts 78. When curbs are not required and curb/gutter unit 13 is not in use, plate 76 may be bolted directly to the winching frame unit 12 by utilizing holes 79.

In operation, screed 10 is supported on side forms 95 and end play is reduced by vertical glide plates 97 which are integrally secured to the vertical end of hopper 172 and extend downward as best seen in FIGS. 1 and 3. Plates 97 slide on the side surfaces of forms 95. The speed and angle of winching can be controlled as previously explained and accomplished automatically while the screeding and curb/gutter-forming operations are taking place. Wet concrete is poured in front of screed 10 and is worked and finished by base frame unit 11 and winching units 12 while curb/gutter-forming units 13 and associated probe vibrators 88 vibrate and work the wet concrete poured in front of units 13. Additional wet concrete is poured into hoppers 172 as screed 10 moves forward to form the curb and gutter simultaneous with formation of the roadway. Skirt 100 smooths the finished curb with an essentially vibration-free surface due to the vibration dampening effect of sheet 101. If desired, some of the wet concrete can be placed on top of skirt 101 to give added weight in the smoothing process.

In summary it can be seen that an extremely versatile screed and curb/gutter-forming unit has been provided. A particular advantage to the trade is the fact that both curbs and gutters can be formed and smoothed simultaneously with forming the road, walkway, or the like. While some touch-up and smoothing work is generally always required on any type of curb and road job, the improved vibrator and skirt arrangement of the present invention have been found to substantially improve the curb-forming operation and to substantially reduce the amount of such touch-up work required by improving the manner in which the concrete is vibrated and the curb/gutter is shaped and thereafter by improving the manner in which the smoothing operation is effected. The auxiliary unit used forb curb/gutter forming can, as previously noted, include the winching apparatus as desired or the winching unit can be installed on the base frame unit without use of the curb/gutter forming unit. Thus, substantial versatility is provided particularly for the small contractor.

I claim:

1. In a concrete screed of the type having a base screed unit including:

(i) an elongated, open frame structure mounting a plurality of screed plates for engaing and leveling concrete as the screed is moved over the concrete;

(ii) a base unit vibrating element comprising a base unit shaft rotatively supported in said frame structure and having means operatively associated therewith enabling said base unit shaft when driven to impart vibrations to each of said screed plates; and (iii) drive means mounted intermediate the ends of said base screed unit and connected to drive said base unit shaft to impart said vibrations to said plates;

the improvement comprising:

(a) a detachable auxiliary combined screed and curb-forming unit adapted to be paired with another similar auxiliary unit on opposite ends of said base screed unit, said auxiliary unit comprising:

(i) an elongated, open frame structure adapted to mate the open frame structure of said base screed unit with an equal plurality of mating screed plates for engaging and leveling concrete for a portion of the length of the auxiliary unit as an extension of the length engaged and leveled by said base unit screed plates and having curb-forming means for engaging the concrete and for the remaining portion of the length of the auxiliary unit forming a curb as an extension of the length engaged and leveled by said mating screed plates;

(ii) means for detachably connecting an end portion of said auxiliary unit open frame structure to an adjacent end portion of said base unit in a predetermined angular relationship;

(iii) a hopper mounted on said auxiliary unit frame structure having an open top and an open bottom extending through said curb-forming means; and (iv) an elongated vibrator connected to be driven by said base unit shaft and mounted on said auxiliary unit frame structure in a position to be at least partially submerged in the concrete forward of said hopper in the direction of screeding;

whereby when said drive means on said base unit operates and rotates said base unit shaft, said auxiliary combined screed and curb-forming unit is enabled to vibrate the concrete forward of the hopper prior to forming a curb therefrom and to thereafter screed the concrete and in conjunction with additional concrete fed through said hopper form a curb at one end of said base unit simultaneous with said base unit screeding the concrete between the ends thereof.

2. In a concrete screed as claimed in claim 1 wherein said auxiliary unit includes a smoothing skirt trailing said auxiliary unit in the direction of screeding and providing a smoothing surface as a continuation of the curb-forming surface of said auxiliary unit, said skirt being formed of a material adapted to dampen vibrations imparted thereto thereby enabling the surface of the concrete having the curb formed therefrom to be smoothed with a vibration dampening surface.

3. In a concrete screed as claimed in claim 2 including a winching unit mounted on said auxiliary unit and having cabling and drive means adapted to be powered off said base unit shaft thereby enabling said winching unit and vibrator to be powered by said base unit shaft.

4. In a concrete screed as claimed in claim 3 wherein said auxiliary unit includes a shaft extending for a portion of the length thereof, said auxiliary unit shaft being connected to be driven by said base unit shaft and having means operatively associated therewith enabling said auxiliary unit shaft when driven to impart vibrations to said auxiliary unit mating screed plates and wherein both said vibrator and said winching unit drive means are connected to be powered by said auxiliary unit shaft.

5. In a concrete screed as claimed in claim 4 wherein said winching unit drive means comprises a circulating hydraulic pump-motor system and the motor component thereof is mounted on the extreme outer end of said auxiliary unit for operating said cabling means.

6. The method of forming curbs with a vibrating screed and hopper fed curb-forming apparatus comprising:

(a) pouring the wet concrete mix to be formed into a curb in front of the hopper fed curb-forming apparatus;

(b) while pouring additional wet concrete mix through the hopper and vibrating the concrete mix forward of the hopper moving the apparatus forward in the direction of screeding to form the curb; and (c) while the apparatus moves forward smoothing the formed curb with a trailing curb-conforming skirt adapted to dampen any vibrations imparted to the skirt from the apparatus.

* * * * *